United States Patent [19]

Elliott

[11] Patent Number: 4,516,708

[45] Date of Patent: May 14, 1985

[54] FINGER RING HOLDER

[76] Inventor: Lee A. Elliott, 7425 Lamon Ave., Skokie, Ill. 60077

[21] Appl. No.: 574,973

[22] Filed: Jan. 30, 1984

[51] Int. Cl.[3] ..... A44C 11/02; A44C 9/00

[52] U.S. Cl. ..... 224/257; 224/255; 224/268

[58] Field of Search ..... 224/257, 255, 268; D3/61

[56] References Cited

U.S. PATENT DOCUMENTS 2,665,042 1/1954 Starolis ..... 224/255

*Primary Examiner*—Stephen Marcus

*Assistant Examiner*—David Voorhees

*Attorney, Agent, or Firm*—Shlesinger Arkwright Garvey & Fado

[57] ABSTRACT

A ring holder for attachment to a necklace or the like having a first member with a U-shaped loop at one end is provided. The first member includes an eyelet to permit the ring holder to be suspended from a necklace. A second member extends upwardly from one leg of the loop in helical manner about the first member and terminates in an end which is spaced a distance sufficient to permit a ring to be placed over the end and between the first and second members. A ring when so placed will spiral downwardly along the helix of the second member until it is received and stored by the loop.

7 Claims, 6 Drawing Figures

FINGER RING HOLDER

BACKGROUND OF THE INVENTION

Finger rings have always been a popular type of jewelry for both men and women. The recent great increases in the price of the metals and stones from which the rings are manufactured has greatly increased their value. Additionally, many people find that these rings attain a great sentimental value which cannot be compensated for by any amount of money. Consequently, the loss of one of these rings, is a matter of great concern.

The employment conditions of many wearers of finger rings requires that no rings be worn during some or all of the working period. Consequently, these persons must find a secure place for storing and holding their rings in order to prevent their accidental loss or theft. It also frequently happens that the rings must be removed from the finger for many other reasons. Consequently, a finger ring holder which prevents accidental dislocation of the ring while simultaneously permitting the holder to be secured to the body of the wearer is advantageous.

Starolis, U.S. Pat. No. 2,665,042 discloses a finger ring protector in which a catch having a leg displaceable to permit passage of a ring therethrough is disclosed. The finger ring protector of Starolis discloses a flexible securing member for attachment to the wearer and a jump ring to prevent accidental opening of the catch member. The finger ring protector of Starolis has many disadvantageous features, not the least of which is the difficulty of utilizing the protector with a necklace.

Magerhaus, U.S. Pat. No. 153,717, discloses a toy puzzle having a plurality of spirals disposed about an integral central member. The spirals are of a constantly decreasing diameter and resemble a tree in side elevation. The puzzle has a clamp at one end thereof and the trick of the puzzle is to remove along the central member a ring engaging one of the spirals. The puzzle of Magerhaus is unsuitable for providing a finger ring protector which may be suspended from a necklace because the large diameter of the lowermost spiral would cause the puzzle to be displaced outwardly a substantial distance from the body of the wearer. Additionally, the catch prevents ready removal or insertion of the finger ring when so desired.

OBJECTS AND SUMMARY OF THE INVENTION

The disclosed invention provides a novel and unique finger ring protector which is adapted for being suspended from a necklace worn by the wearer of the ring The holder or protector includes a first member with a U-shaped loop at one end thereof and a plurality of spirals which extend from the loop around the first member and resemble a helix. The second member is terminated at the upper end of the holder and a ring or rings placed around the terminated end will spiral down the second member and be secured on the loop. Accidental dislodgement is prevented by the spirals of the second member. Consequently, the disclosed invention provides a unique finger ring protector which may be secured to the wearer while permitting ready storage and removal of the ring or rings and simultaneously preventing accidental release thereof.

It is a primary object of the disclosed invention to provide a finger ring protector which overcomes the disadvantages of the prior art.

An additional object of the disclosed invention is to provide a finger ring protector which may be worn with a separable necklace which may be changed as desired.

Yet another object of the disclosed invention is to provide a finger ring protector which prevents accidental release of a finger ring while permitting the finger ring to be readily stored and simply and intentionally released.

Yet a further object of the disclosed invention is to provide a finger ring protector which may be manufactured to resemble a piece of jewelry.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
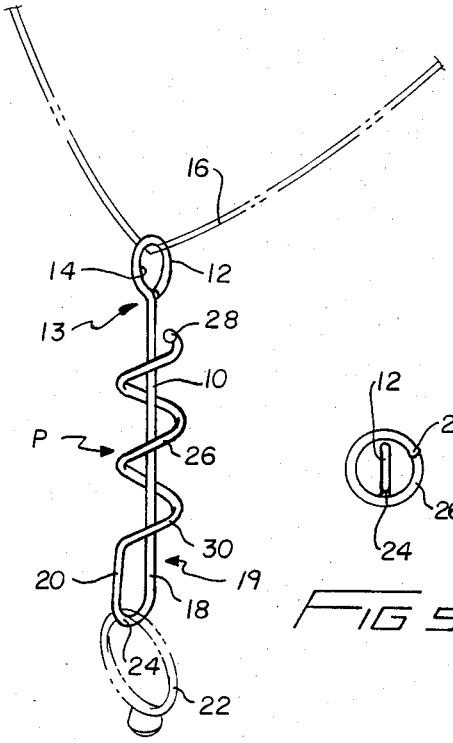
FIG. 1 is a front perspective view of a finger ring protector according to the invention with the ring and a necklace shown in phantom lines.
Figure 5:
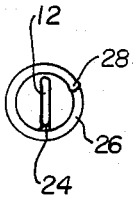
FIG. 5 is a top plan view of the finger ring protector of FIG. 1.
Figure 2:
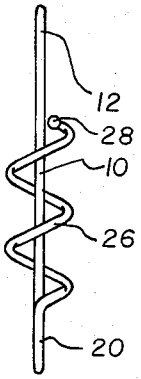
FIG. 2 is a front elevational view of the finger ring protector of FIG. 1.

A finger ring protector P, as best shown in FIGS. 1–2 and 5, includes a first member 10 having a straight portion of substantial length. An eyelet 12 is integral with the upper end 13 of first member 10. Eyelet 12 is looped around and terminates adjacent upper end 13 of first member 10 and thereby defines an aperture 14 to permit a necklace 16 to pass therethrough. The aperture 14 is of a substantial diameter so that a necklace, chain, or other similar type of article may be utilized in the wearing of the finger ring protector P. Generally, a necklace 16 has a clasp (not shown) to permit the necklace 16 to be opened and the aperture 14 is preferably sized so that the clasp (not shown) will pass therethrough and thereby permit the protector P to be suspended from the necklace 16. Additionally, the necklace 16 may therefore be replaced by another as desired.

A U-shaped loop 18 is integral with and extends from a second end 19 of first member 10 spaced from eyelet 12. Loop 18 includes a first leg 20 spaced from first member 10 a sufficient distance to permit a ring 22 to be stored in the U 24 of the loop 18.

A second member 26 extends upwardly from first leg 20 and terminates in an end 28. The second member 26 is shaped in helical form around first member 10 and the aligned spirals of the helix maintain a constant radius from first member 10. Similarly, end 28 is spaced from first member 10 a distance sufficient to permit ring 22 to be placed around end 28 and between first member 10 and second member 26. The loop 18 has a height substantially equal to the weight of one of the spirals of member 26.

Placing the ring 22 about the end 28 and between the members 26 and 10 will permit the ring 22 to spiral down along the coils of the helix 26 to thereby be stored and received in the U 24 of loop 18. The ring 22 will be prevented by the coils of the helix, such as the first coil 30, from being accidentally dislodged. Consequently, the ring 22 when stored by protectcr P will be safely positioned to prevent accidental dislodgement even should the protector P be bounced or rattled by movement of the wearer (not shown) of the necklace 16. The ring must travel through at least 360° before it can be released.

Should the wearer (not shown) of the necklace 16 desire to release the ring 22 from the protector P, then shifting of the loop 18 from its first lower ring storage position to its second upper ring released position will cause the ring 22 to spiral along the coils of the helix 26 and pass beyond the end 28 to thereby be released. One skilled in the art will appreciate that the weight of the ring 22 when stored on the loop 18 will enable the gravitational forces acting on the ring 22, as well as the protector P, to maintain the loop 18 in its lower storage position. Consequently, the ring 22 will be stored by the loop 18 and the protector P will be vertically suspended from the necklace 16.

Figure 3:
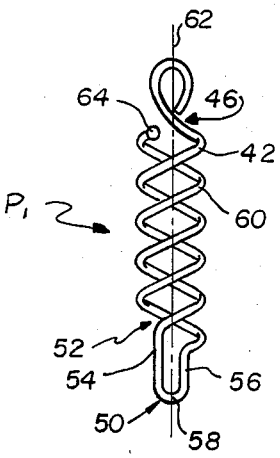
FIG. 3 is a side elevational view of another embodiment of a finger ring protector.
Figure 6:
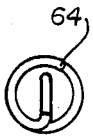
FIG. 6 is a top plan view of the finger ring protector of FIG. 3.
Figure 4:
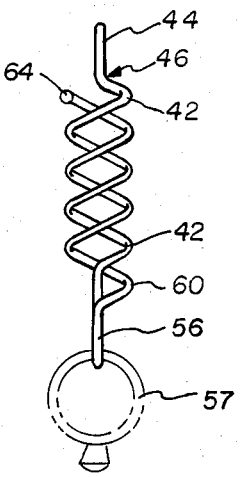
FIG. 4 is a front elevational view of the finger ring protector of FIG. 3.

The finger ring protector P1, as best shown in FIGS. 3–4 and 6, includes a first member 42 which is disposed in a plurality of aligned spirals having a constant diameter. The first member 42 resembles, therefore, a helix. An eyelet 44 extends from the upper end portion 46 of first member 42 and is looped arou:d so as to form a closed loop. The eyelet 44 defines therefore a closed aperture 48 of a diameter sufficient to permit the clasp of a necklace, such as the necklace 16 of FIG. 1, to be positioned therethrough so to permit the protector P1 to be vertically suspended from the necklace.

A U-shaped loop 50 is integral with and extends from second end portion 52 of helix 42. Loop 50 includes legs 54 and 56 joined by connecting U-shaped portion 58. The legs 54 and 56 are separated a distance sufficient to permit a ring, such as the ring 57 of FIG. 4, to be disposed therebetween around the U 58. Second helical member 60 has a plurality of aligned spirals extending upwardly from second leg 56. The spirals of the helix 60 as well as the spirals of the helix 42 are intertwined and resemble a double helix. The spirals of the intertwined helixes 42 and 60 are disposed to have a constant radius from a longitudinal axis 62 which is centrally disposed along protector P1. Second member 60 terminates in an end 64 which is spaced a distance from upper end portion 46 of first member 42 a distance sufficient to permit a ring, such as ring 22 of FIG. 1, to be placed about end 64 and between members 42 and 60.

As has been previously described in the operation of the protector P of FIGS. 1–2 and 5, a ring, such as ring 57 of FIG. 4, will spiral downwardly along the spirals of the helix 60 until the ring 57 is positioned between the legs 54 and 56 of the loop 50 and stored by the U 58. The spirals of the helixes 42 and 60 prevent the ring 57 from being accidentally dislodged by the bouncing or shaking of the protector P1. Should the wearer of the protector P1 decide to remove the ring 57, then shifting of the loop 50 from the lower ring storage position to upper ring release position will cause the ring 57 to spiral along the spirals of the helix 60 until the ring 57 passes beyond the end 64 and is released.

While this invention has been described as having a preferred design, it is understood that it is capable of further modifications, uses and/or adaptations of the invention following in general the principles of the invention and including such departures from the present disclosure as come within known or customary practice in the art to which the invention pertains, and as may be applied to the central features herein before set forth, and fall within the scope of the invention of the limits of the appended claims.

What I claim is:

1. A ring holder for attachment to a necklace or the like, which does not require resiliency to retain a ring thereon, comprising:

(a) a first member having first and second end portions including means disposed at said first end portion for vertically suspending said first member from said necklace;

(b) a generally U-shaped loop, one leg of said loop extending from said second end portion of said first member for receiving a ring thereon;

(c) a second member extending from the other leg of said loop and including a plurality of spirals spaced from said first member a distance sufficient to permit a ring to be freely placed between said first and second members and generally helically disposed about said first member;

(d) said second member terminating in an end spaced from said first end portion a distance sufficient to permit a ring to be placed about said terminating end and between said first and second end portions;

(e) whereby said ring will spiral about said second member and be received and stored on said loop and thereby retained by said spirals without permitting substantial vertical movement of the ring when vertical motion is imparted to the ring holder and thus avoiding accidental removal therefrom.

2. The holder as defined in claim 1, wherein:

(a) said first and second members and said loop are integral.

3. The holder as defined in claim 1, wherein:

(a) said first member includes a straight portion of substantial length.

4. The holder as defined in claim 1, wherein:

(a) said second member includes a plurality of spirals which are aligned and spaced an equal distance from said first member.

5. The holder as defined in claim 1, wherein:

(a) said first member includes a plurality of aligned spirals; and, (b) said second member includes a plurality of spirals whereby said first and second members form a double helix.

6. The holder as defined in claim 5, wherein: (a) said first and second member spirals being spaced a constant distance from a longitudinal axis of said helix.

7. The holder as defined in claim 1, wherein:

(a) said loop having a height substantially equal to the height of the spiral.

* * * * *